United States Patent [19]

Stetler

[11] 4,283,870

[45] Aug. 18, 1981

[54] FRAME DEVICE

[76] Inventor: Peter J. Stetler, 144-30 Roosevelt Ave., Flushing, N.Y. 11354

[21] Appl. No.: 659,138

[22] Filed: Feb. 18, 1976

[51] Int. Cl.[3] ..... G09F 1/12

[52] U.S. Cl. ..... 40/154; 40/155

[58] Field of Search ..... 40/152, 154, 155; 428/906, 13-14; 52/656, 758 H, 98, 105; 206/390, 820

[56] References Cited

U.S. PATENT DOCUMENTS

| | | | |
|---|---|---|---|
| 3,082,864 | 3/1963 | Silver | 40/154 X |
| 3,200,526 | 8/1965 | Munn | 40/152 |
| 3,529,374 | 9/1970 | Spertus | 40/152 |
| 3,698,114 | 10/1972 | Hirsch et al. | 40/155 |
| 3,736,684 | 6/1973 | Grad | 40/152 |
| 3,837,106 | 9/1974 | Lofstrom | 40/104.03 |
| 3,883,975 | 5/1975 | Mentken | 40/155 |

FOREIGN PATENT DOCUMENTS

| | | | |
|---|---|---|---|
| 624916 | 6/1949 | United Kingdom | 40/154 |

*Primary Examiner*—E. H. Eickholt

*Attorney, Agent, or Firm*—Philip Rodman

[57] ABSTRACT

The frame device comprises a main body portion having a pair of oppositely disposed limb members joined in a fixed position to the main body portion when the frame devices is in an assembled condition. One or both limb members are either movable on the main body portion or detached therefrom when the frame device is in an unassembled condition.

Frame members incorporating the structure of the frame device are assembled to form a closed peripheral arrangement for framing an artwork and/or other materials. The frame members are mitered conventionally where appropriate or in accordance with guide indicia formed on the frame device. The frame members are attached at their mitered ends with angle members where appropriate or in a suitable known manner. The frame members include openings for selective installation of hanger members that permit accommodation of a frame suspension member such as a wire or hook.

The frame device can also include a protective sheet secured to one of the limb members.

18 Claims, 35 Drawing Figures

Fig. 1.
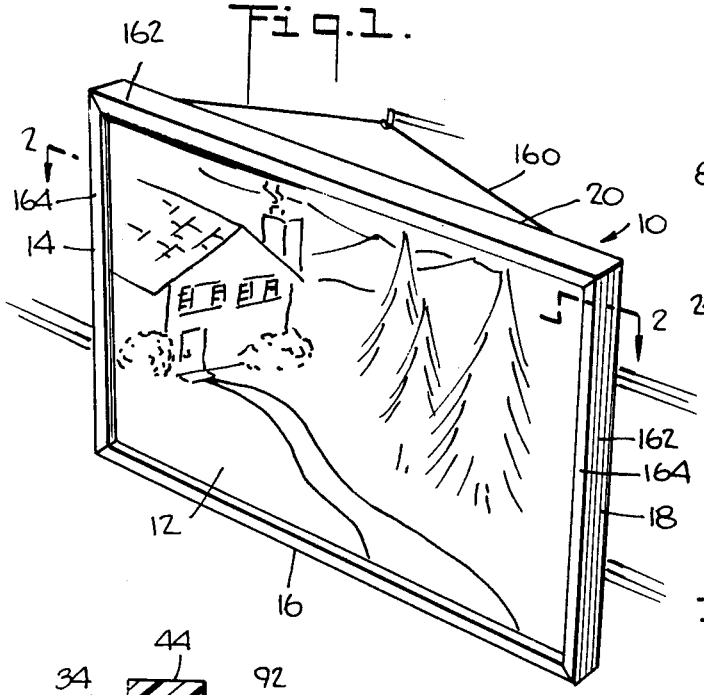
Fig. 2.
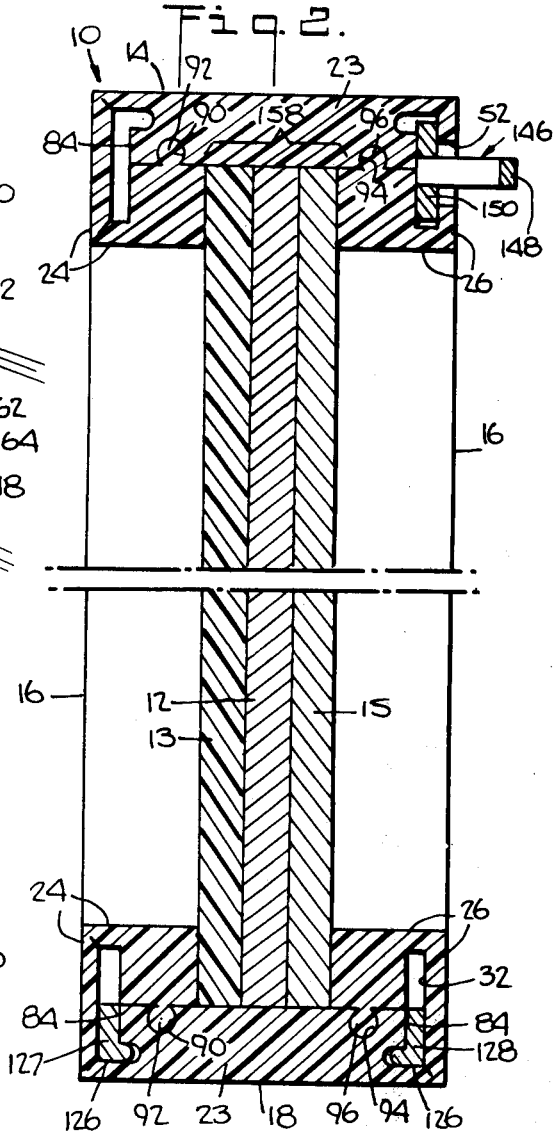
Fig. 8.
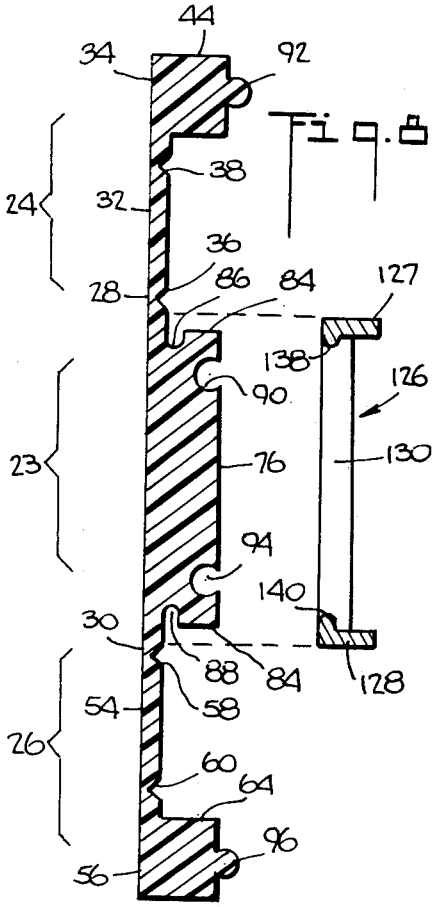
Fig. 9.
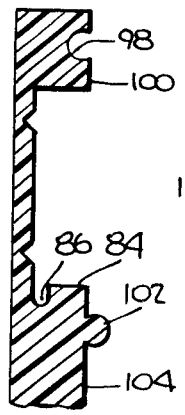
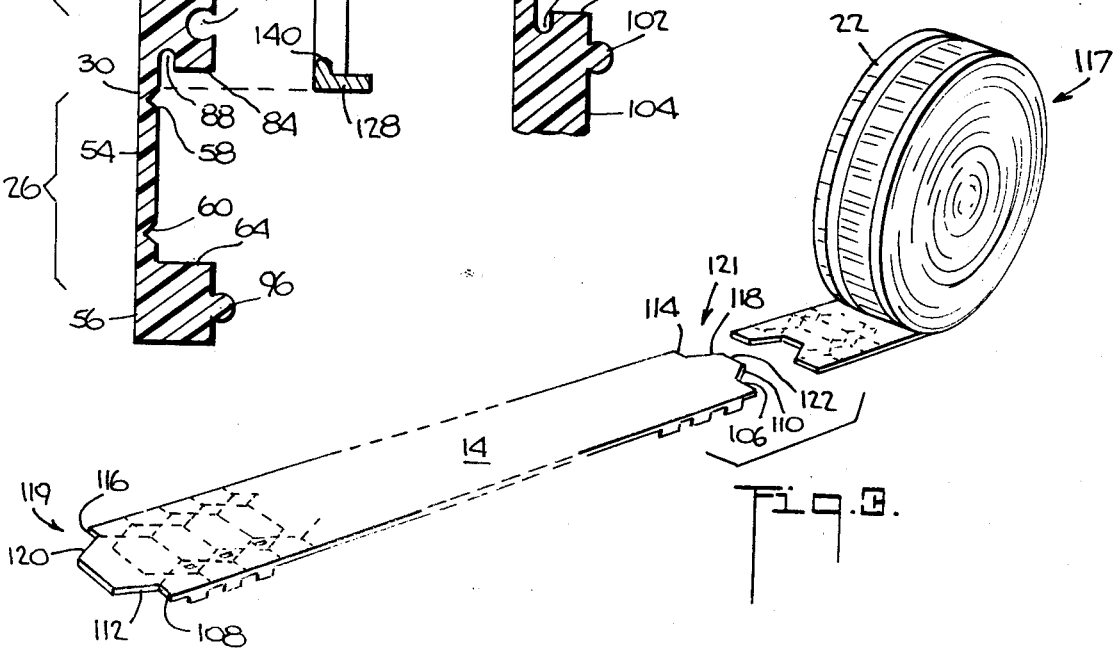
Fig. 3.

Fig.13.
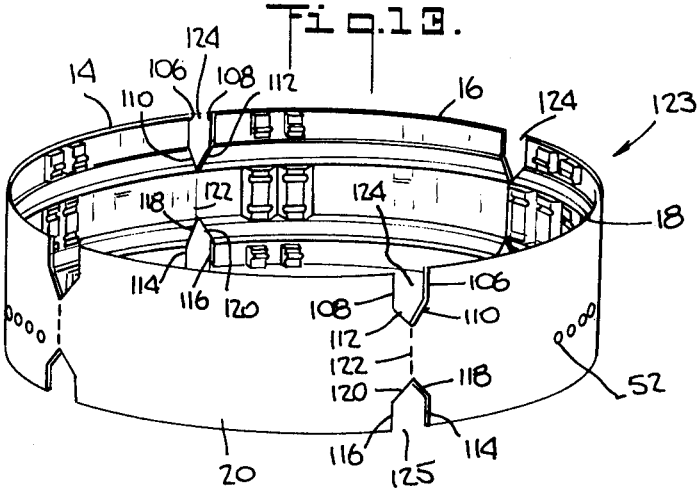
Fig.14.
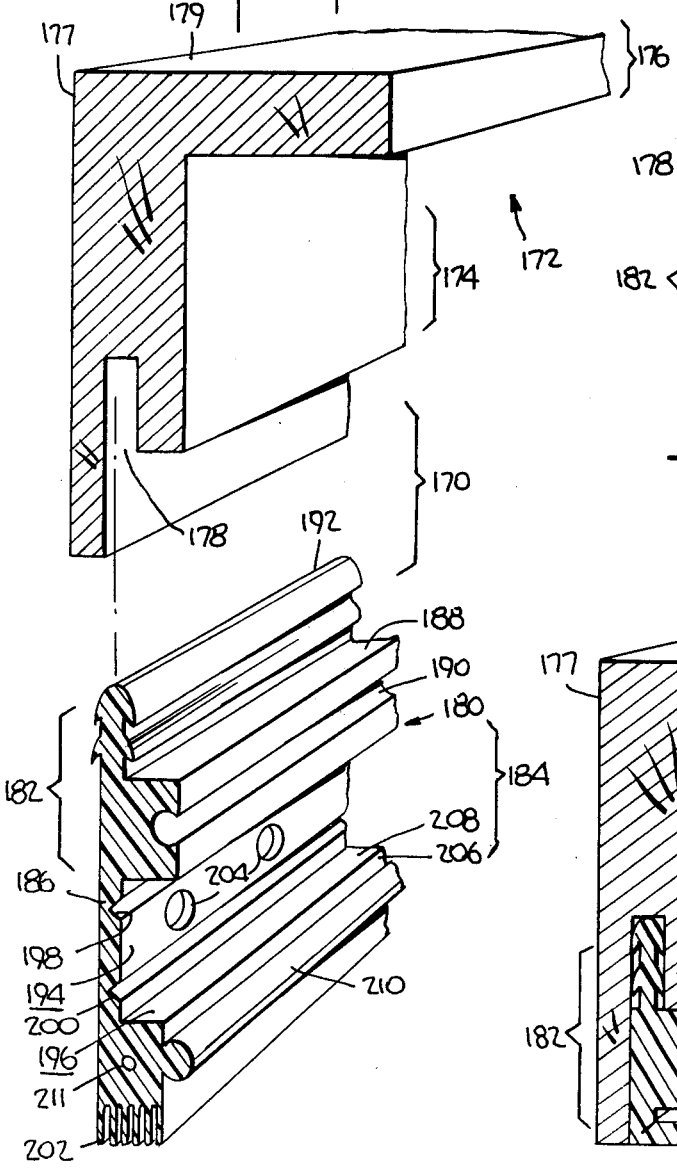
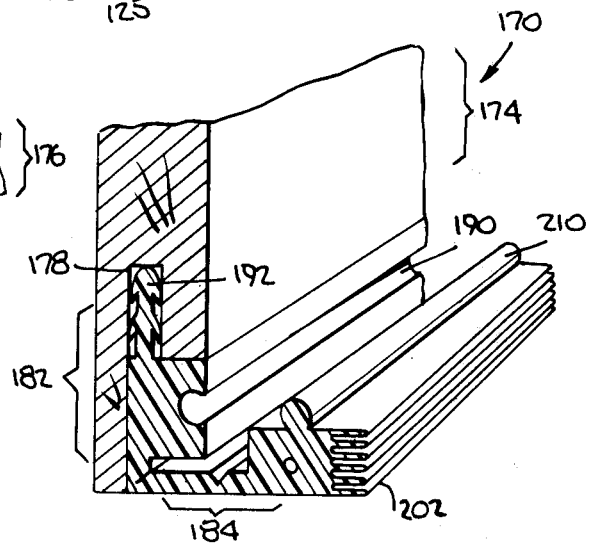
Fig.15.
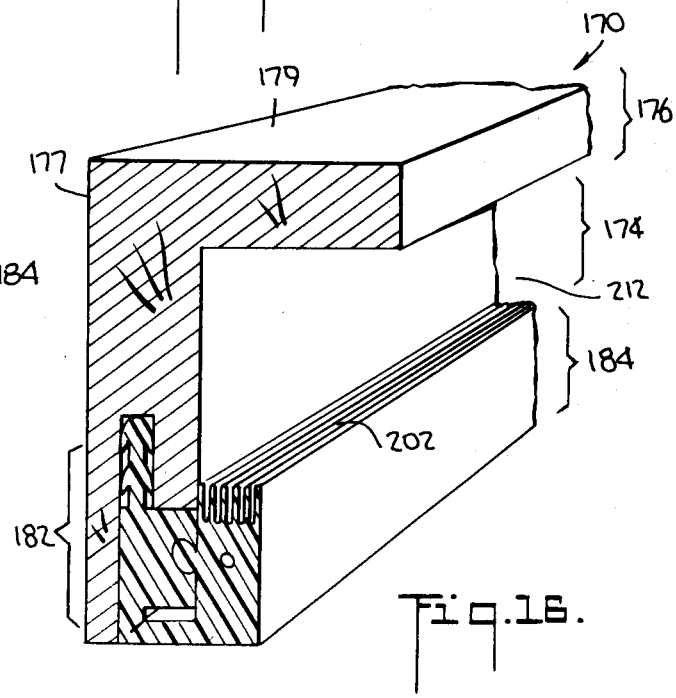
Fig.16.

Fig.17.
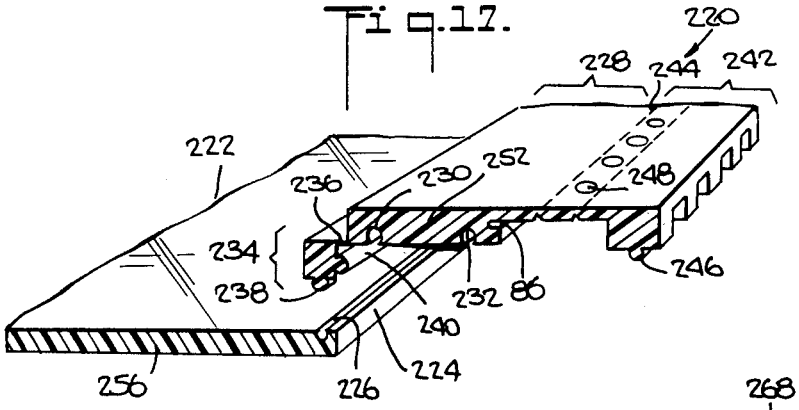
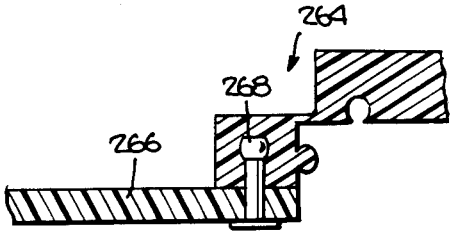
Fig.21.
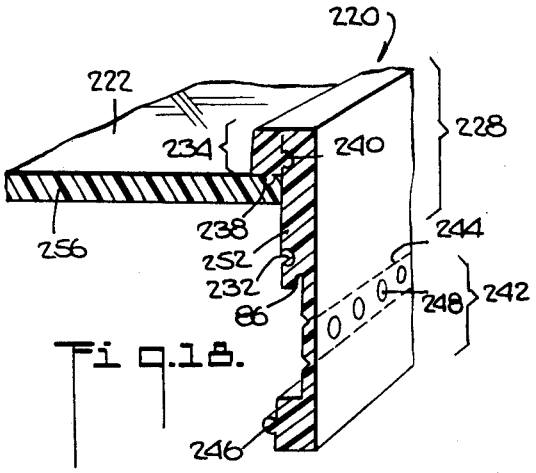
Fig.18.
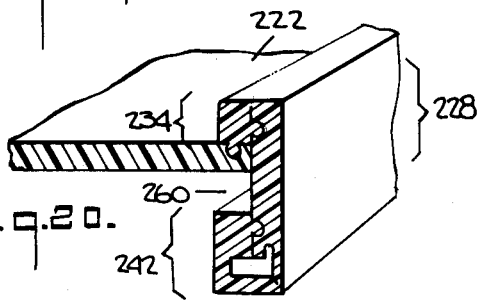
Fig.20.
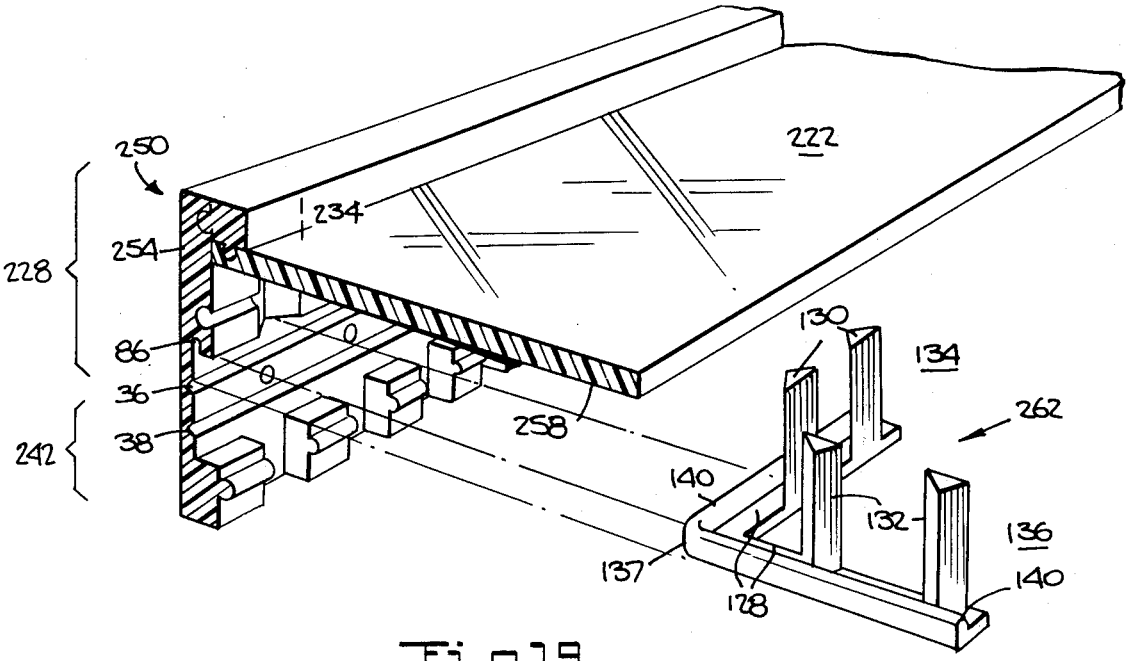
Fig.19.

Fig.22.
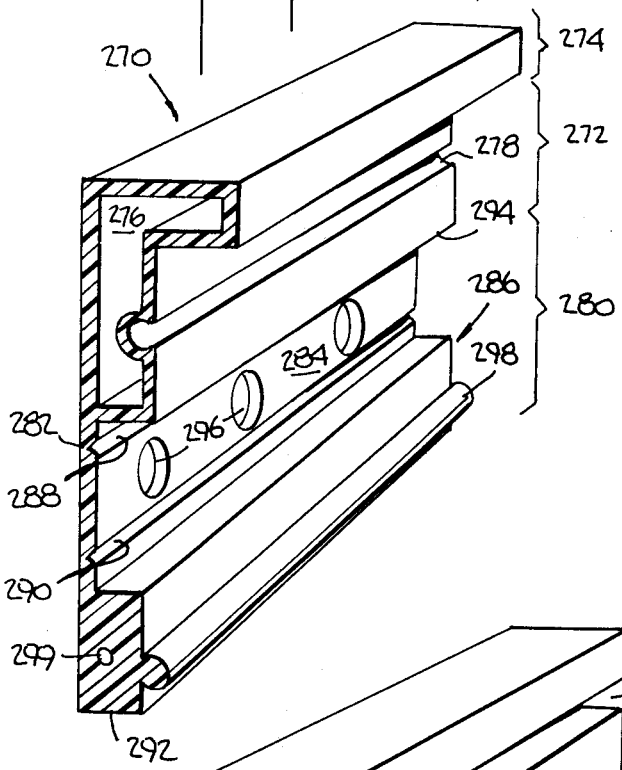
Fig.23.
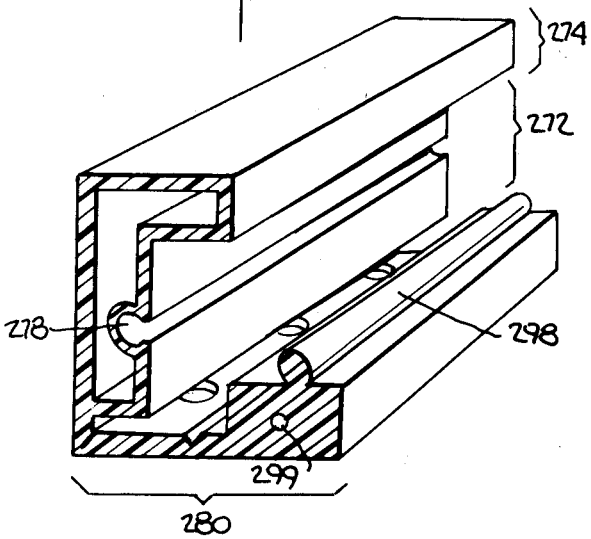
Fig.24.
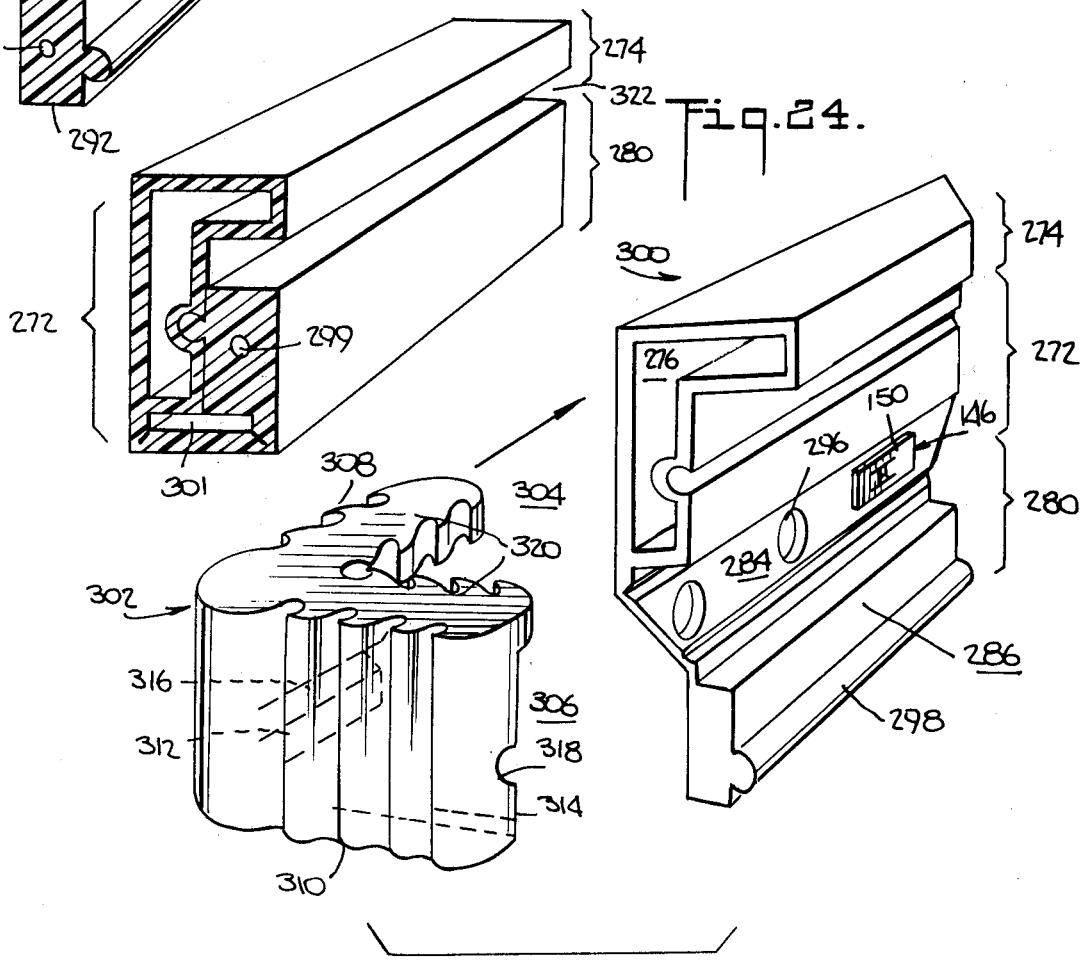
Fig.25.

FRAME DEVICE

This invention relates to frames, and more particularly to a frame device that can be prefabricated into frame members and assembled to accommodate artwork such as pictures, prints and paintings.

Frames are generally used to protect, support and/or enhance the appearance of paintings, pictures, prints and other similar articles (hereinafter referred to as artwork). The art of fashioning a frame so that it forms a compatible esthetic combination with a particular artwork usually requires the skill, creativity and imagination of an expert. Many art patrons however, cannot afford the expenses incurred in utilizing the services of a framing expert. A popular alternative is to obtain standard do-it-yourself picture frame stock or kits that are sold in various retail outlets and department stores.

Although the assembly of a picture frame from standard frame stock or kits usually does not require expert skills, some facility with tools is generally helpful. For example one known standard wood frame includes frame members that receive brackets, fittings, fasteners and/or other accessories installed by nailing, screwing or otherwise anchoring them to the frame members. It is not unusual for a novice to split a frame, break a glass sheet or damage the artwork during assembly of this type of frame.

Another known do-it-yourself frame kit, equipped with metal frame members, is usually less difficult to assemble than the wooden frame previously described but is generally more expensive than the wooden frame.

It is thus desirable to provide a frame device that is relatively inexpensive to manufacture and is easily prefabricated into individual frame members for assembly on a do-it-yourself basis by the ultimate user.

Among the several objects of the present invention it may be noted the provision of a novel frame device yielding frame members that can be fully assembled with artwork disposed therein without using tools; a novel frame device that is flexible in an unassembled condition and inflexible in an assembled condition; a novel frame device having a hanger member that can be secured thereto without tools or fasteners; a novel frame device that can be cut with a pair of household scissors or the like to form frame members of predetermined size; a novel frame device that can be mitered with a pair of household scissors or the like; a novel frame device that can be wound in a roll in spiral fashion; a novel frame device that includes a main body portion and at least one limb member that is detached from the main body portion when the frame device is in an unassembled condition; a novel frame device that includes a main body portion and at least one foldable limb member movably hinged to the main body portion when the frame device is in an unassembled condition; and, a novel frame device that is economical to manufacture, is formed of readily available materials including plastics and can be formed into prefabricated frame members that are easily assembled. Other objects and features will be in part apparent and in part pointed out hereinafter.

The present invention relates to a novel frame device. The frame device comprises a main body portion having a pair of oppositely disposed limb members joined in a fixed position to the main body portion when the frame device is in an assembled condition. One or both limb members are either movable with respect to the main body portion or detached therefrom when the frame device is in an unassembled condition.

Frame members of predetermined size incorporating the structure of the frame device are mitered conventionally where appropriate or in accordance with guide indicia formed on the frame device. The mitered frame members are attached with angle members where appropriate or in a suitable known manner to form a closed peripheral arrangement. One limb member of each frame member in the closed peripheral arrangement is in a fixed position on the main body portion to serve as a ledge for receiving artwork and/or other materials that are to be framed. The other limb member of each frame member is not engaged in a fixed position on the main body portion prior to installation of the artwork on the receiving ledge. Preferably the unengaged limb members of a selected pair of oppositely disposed frame members include openings for accommodating a hanger member.

After the material to be framed is deposited on the receiving ledge of the closed peripheral arrangement and the hanger members are installed in their respective limb member openings the unengaged limb members of each frame member are engaged in fixed positions on their respective main body portions. The material framed is thus disposed in a channel defined between the limb members of each frame member. The hanger members accommodate a suspension member such as a wire or hook for hanging the assembled frame.

The frame device can also include a protective sheet secured to one of the limb members.

The invention accordingly comprises the constructions hereinafter described, the scope of the invention being indicated in the following claims.

In the accompanying drawings in which various embodiments of the invention are illustrated:

FIG. 1 is a perspective view of a frame incorporating the frame device of the present invention;

FIG. 2 is an enlarged sectional view taken along the line 2—2 of FIG. 1;

FIG. 3 is a simplified perspective view of the frame device wound into a roll;

FIG. 8 is a sectional view taken along the line 8—8 of FIG. 4;

FIG. 9 is a modification of the frame device shown in FIG. 8;

FIG. 13 is another embodiment of a frame device incorporating my invention;

FIG. 14 is an exploded fragmentary perspective view of another embodiment of my invention;

FIG. 15 shows the elements of FIG. 14 partially assembled;

FIG. 16 shows the elements of FIG. 15 fully assembled;

FIG. 17 is an exploded fragmentary perspective view of another embodiment of my invention;

FIG. 18 shows the elements of FIG. 17 partially assembled;

FIG. 19 shows the opposite side thereof including an angle member exploded therefrom;

FIG. 20 shows the elements of FIG. 18 fully assembled;

FIGS. 21 and 22 show other embodiments of a frame device incorporating my invention;

FIG. 23 shows the frame device of FIG. 22 in partially folded condition;

FIG. 24 shows the elements of FIG. 23 fully folded and assembled;

FIG. 25 shows a mitered frame member with an angle member exploded therefrom;

Corresponding reference characters indicate corresponding parts throughout the several views of the drawings.

Figures 4, 5:
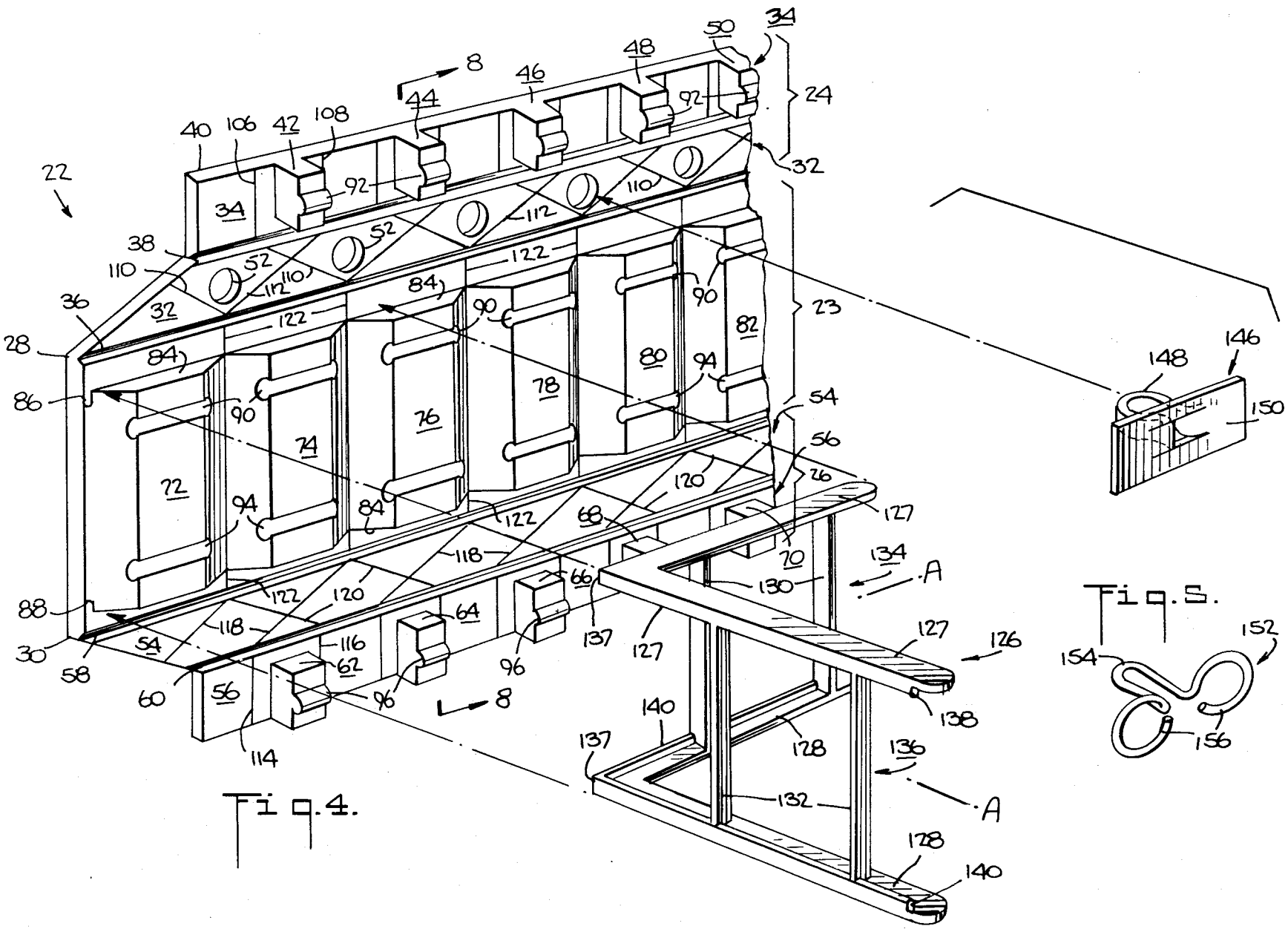
FIG. 4 is an exploded fragmentary perspective view of the frame device, an angle member, and a hanger member.
FIG. 5 is another embodiment of the hanger member.

Referring now to the drawings, a frame 10 containing artwork 12, a protective sheet 13 such as glass, and a backing material 15, comprises a plurality of peripheral frame members 14, 16, 18 and 20. The frame members 14 and 18 are of identical length as are the frame members 16 and 20 with each frame member incorporating the structure of a frame device 22 as shown in perspective in FIGS. 4, 6 and 7.

The frame device 22, which can be formed of polypropylene for example, comprises an elongated main body portion 23 and oppositely disposed elongated limb members 24 and 26 hinged to said main body portion at 28 and 30.

As seen in FIG. 4 the limb member 24 includes foldable sections 32 and 34 having widths respectively defined by elongated folding grooves 36 and 38, and an elongated free edge 40 and the folding groove 38. The limb member 24 also includes a row of bosses such as 42, 44, 46, 48 and 50 formed on the foldable section 34, and a row of openings 52 formed in the foldable section 32.

The limb member 26 includes foldable sections 54 and 56 corresponding to the foldable sections 32 and 34, and folding grooves 58 and 60 corresponding to the folding grooves 36 and 38. The foldable section 56 also includes a row of bosses such as 62, 64, 66, 68 and 70 corresponding to the bosses 42, 44, 46, 48 and 50.

The main body portion 23 includes a row of bosses such as 72, 74, 76, 78, 80 and 82 having opposite terminal portions 84, 84 spaced from the folding grooves 36 and 58. Elongated recess grooves 86 and 88 (most clearly shown in FIG. 8) are formed in the bosses 72, 74, 76, 78, 80 and 82 at the terminal portions 84, 84.

Connecting means for joining the foldable section 34 of the limb member 24 to the main body portion 23 comprise a first recess slot 90 formed in the bosses 74–82 of the main body portion 23 and complementary shaped connecting ribs 92 formed on the bosses 42–50 of the limb member 24. Similar connecting means for joining the foldable section 56 of the limb member 26 to the main body portion 23 comprise a second recess slot 94 formed in the bosses 74–82 of the main body portion 23 and complementary shaped connecting ribs 96 formed on the bosses 62–70 of the limb member 26.

The connecting ribs and recess slots can be reversed as shown in FIG. 9 wherein a recess slot 98 similar to the slot 90 is formed in a limb member boss 100 and a connecting rib 102, similar to the rib 92 is formed on a main body boss 104.

As seen in FIG. 4 vertical guide indicia 106 and 108 are formed on the foldable section 34 and inclined guide indicia 110 and 112 are formed on the foldable section 32. The guide indicia 106 and 110 and the guide indicia 108 and 112 intersect at the folding groove 38. Consecutive guide indicia 110 and 112 intersect at the folding groove 36.

Vertical guide indicia 114 and 116, corresponding to the guide indicia 106 and 108, are formed on the foldable section 56, and inclined guide indicia 118 and 120, corresponding to the guide indicia 110 and 112, are formed on the foldable section 54. The guide indicia 114 and 118, and the guide indicia 116 and 120 intersect at the folding groove 60. Consecutive guide indicia 118 and 120 intersect at the folding groove 58.

The main body portion 23 includes vertical guide indicia 122 formed between adjacent bosses 72 and 74, 74 and 76, 76 and 78, 78 and 80, and 80 and 82. The guide indicia 122 cross the respective intersections of the guide indicia 110 and 112 at the folding groove 36 and also cross the respective intersections of the guide indicia 118 and 120 at the folding groove 58. The distance between consecutive guide indicia 122 of the main body portion 23 is defined as a length increment unit of the frame device 22.

The guide indicia can be scored, indented or otherwise suitably indicated. Preferably the guide indicia have a "V" shaped cross section similar to the folding grooves as shown in FIG. 8. The angle of the groove can be predetermined to provide a substantially flush fit between adjacent mitered corners of the frame members.

The angle of inclination of the guide indicia 110, 112, 118 and 120 will determine the mitering angle of the frame device 22. For example a mitering angle of 45° is achieved with 45° inclinations of the guide indicia 110, 112, 118 and 120.

The frame device 22 can be stocked in any suitable form such as a roll 117 (FIG. 3). The frame members 14, 16, 18 and 20 are cut from a length of the frame device 22 that is unwound from the roll 117. A pair of scissors or other suitable cutting implement is used to cut the frame device 22 along the guide indicia formed thereon. For example one end of the frame member 14, arbitrarily designated the anterior end 119 (FIG. 3) is cut along intersecting guide lines 108, 112, 122, 120 and 116. An arbitrarily designated opposite posterior end 121 is cut along the intersecting guidelines 106, 110, 122, 118, and 114. Corresponding anterior and posterior ends of the frame members 16, 18 and 20 are similarly cut by measuring their desired lengths at the guidelines 122.

The frame members 14, 16, 18 and 20 can also be prepackaged as a loop 123 (FIG. 13) having preformed notches 124, 125 cut at the limb members 24 and 26 along selected guidelines 106, 108, 110, 112 and 114, 116, 118, 120 in accordance with predetermined lengths for the frame members. The frame member lengths 14, 16, 18 and 20 are obtained by cutting from the notches 124 and 125 along the respective guide indicia 122. If desired frame members of any length can be precut in various sizes by a manufacturer or distributor.

An angle member 126, most clearly shown in FIG. 4, comprises spaced angle pieces 127 and 128 joined by webs 130, 130 and 132, 132 to define respective side portions 134 and 136 that intersect at a corner 137. The angle pieces 127 and 128 are symmetrical and respectively include lip portions 138 and 140. The angle member 126, which has a line of symmetry A—A, is molded, cast, stamped or otherwise formed of any suitable known material.

The distance from the corner 137 of the angle member 126 to the nearest webs 130 and 132 is substantially equivalent to the length increment unit of the frame device 22 which was defined as the distance between consecutive guide indicia 122. The distance between adjacent webs 130, 130 and 132, 132 is also substantially equivalent to the length increment unit of the frame device 22.

Referring to FIGS. 4 and 8, the distance between the angle pieces 127 and 128 of the angle member 126 is substantially equivalent to the distance between the terminal portions 84, 84 of any of the bosses 72–82. The respective lip portions 138 and 140 of the angle member 126 are sized to permit detenting in the respective recess grooves 86 and 88. The general thickness of the angle pieces 127 and 128 is substantially equivalent to the distance between the terminal portions 84, 84 of any of the bosses 72–82 and the respective folding grooves 36 and 58.

A hanger member 146 most clearly shown in FIG. 4 comprises an eyelet portion 148 and a base portion 150. The eyelet portion 148 fits through and projects beyond any of the openings 52 in the foldable section 32 of the limb member 24. The width of the base portion 150, as seen in FIG. 2, is substantially equivalent to the width of the foldable section 32. The thickness of the base portion 150 is substantially equivalent to the thickness of an angle piece 127 or 128 of the angle member 126.

In another embodiment a wire-formed hanger member 152 comprises an eyelet portion 154 and a base portion 156 having overall dimensions that substantially correspond to the dimensions of the hanger member 146.

Figure 10:
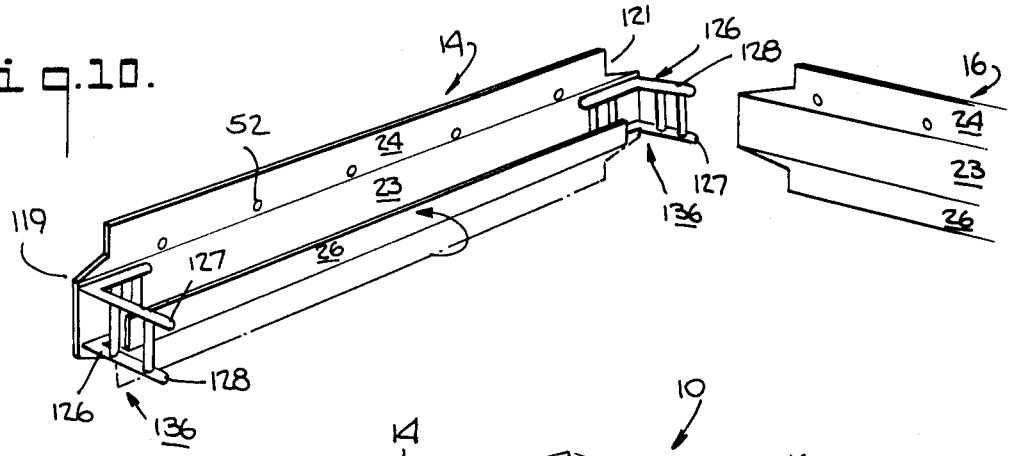
FIGS. 10–12 are simplified schematic representations showing the assembly of a frame incorporating the present invention.
Figure 12:
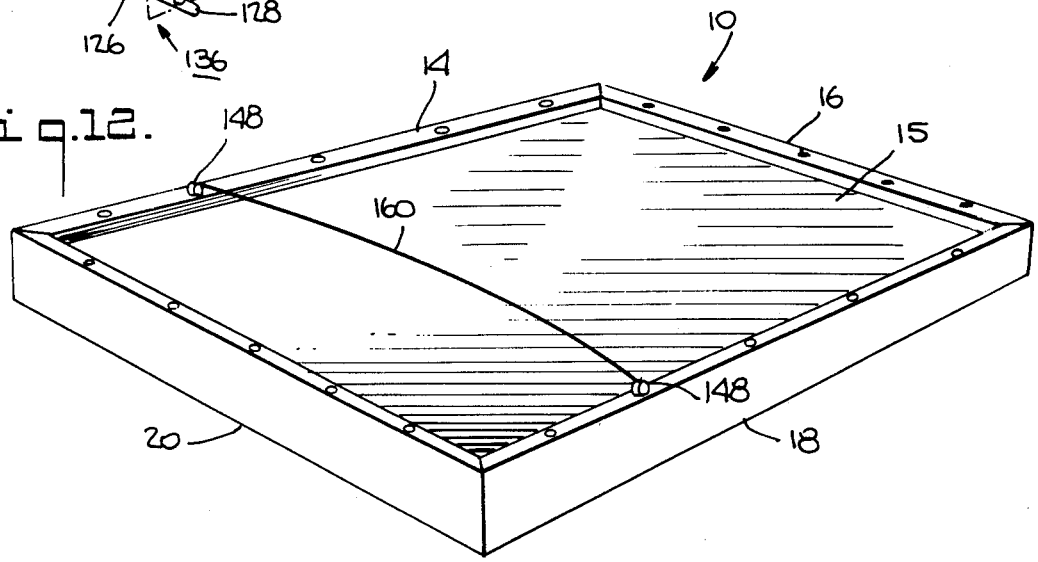
Figure 11:
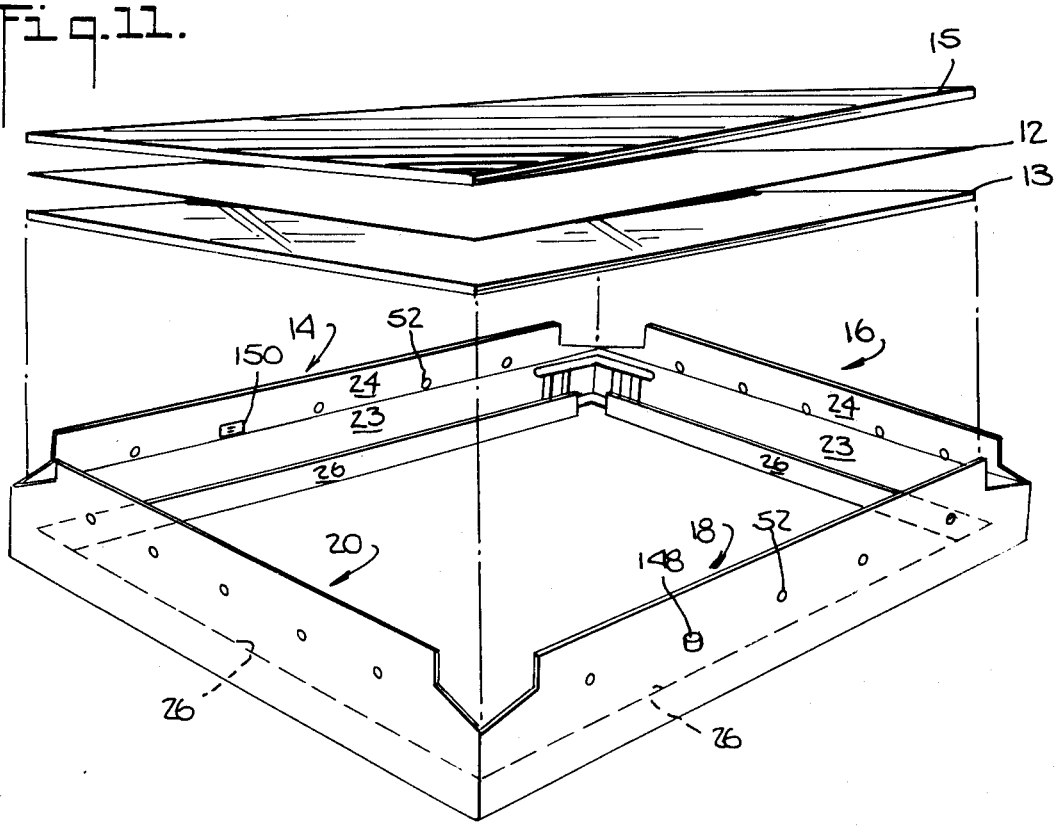

Referring to FIGS. 10–12 the frame 10 is assembled by installing the angle members 126, 126 at the anterior and posterior ends 119, 121 of the frame member 14. It will be noted that certain structural details of the frame members 14, 16, 18 and 20 shown in FIGS. 4, 6, 7 and 8 have been omitted from FIGS. 10–12 for the sake of clarity. A typical installation of the angle member 126 is most clearly shown in FIGS. 4 and 6. The lip portions 138 and 140 on the angle pieces 127 and 128 are respectively detented in the recess grooves 86 and 88 to permit the corner 137 and one of the webs 130 to straddle the boss 72, and both of the webs 130, 130 to straddle the boss 74. The angle member 126 that is provided at an opposite end of a frame member is symmetrically installed in a similar manner.

Figure 6:
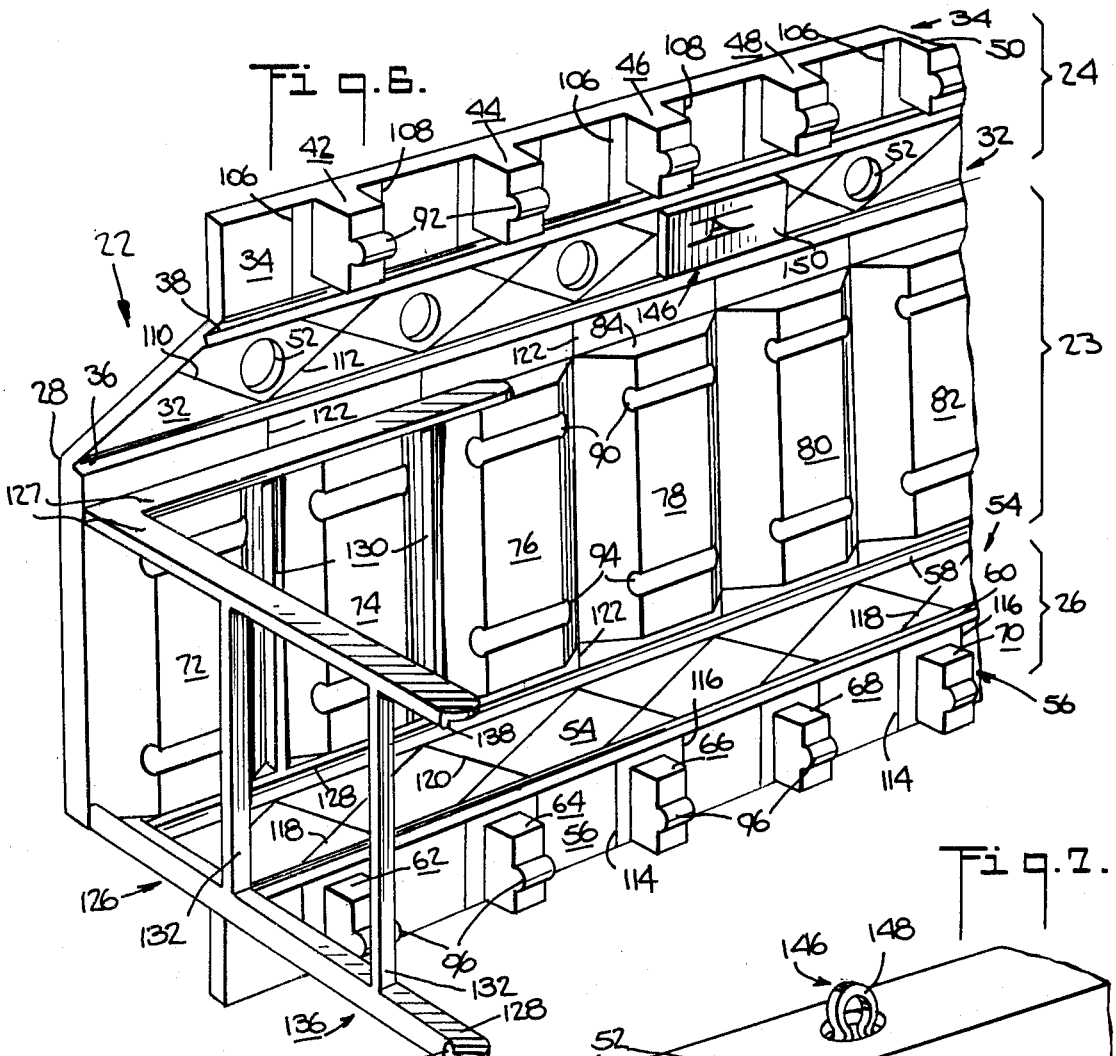
FIG. 6 is a view similar to FIG. 4 showing the angle member and the hanger member installed on the frame device.

Referring to FIGS. 4, 6 and 10 the limb member 26 is folded toward and joined with the main body portion 23 to enable the connecting ribs 96 of the bosses 62, 64, 66, 68 and 70 to respectively engage the recess slots 94 of the bosses 74, 76, 78, 80 and 82. The angle members 126, 126 are thus partially enveloped in a fixed position by the folded limb member 26 and the main body portion 23.

As seen in FIGS. 10 and 11 the side portions 136 of the angle members 126, 126 projecting from the anterior and posterior ends 119 and 121 of the frame member 14 are engaged with corresponding ends of the frame members 16 and 20 in a manner previously described and the respective limb members 26 folded toward and joined with the respective main body portions 23 as previously described. In a similar manner the frame members 16 and 20 are engaged with the frame member 18. The limb members 26 that have been folded and joined with the main body portion 23 of each of the frame members 14, 16, 18 and 20 form a receiving ledge upon which the artwork 12, the protective sheet 13 and the backing material 15 are disposed.

Referring to FIGS. 4, 6 and 11 a pair of hanger members 146 are respectively installed in a selected pair of oppositely disposed frame members, such as 14 and 18. The eyelet portions 148 and 148 project beyond corresponding selected openings 52 while the base portions 150, 150 engage the respective foldable sections 32, 32.

Figure 7:
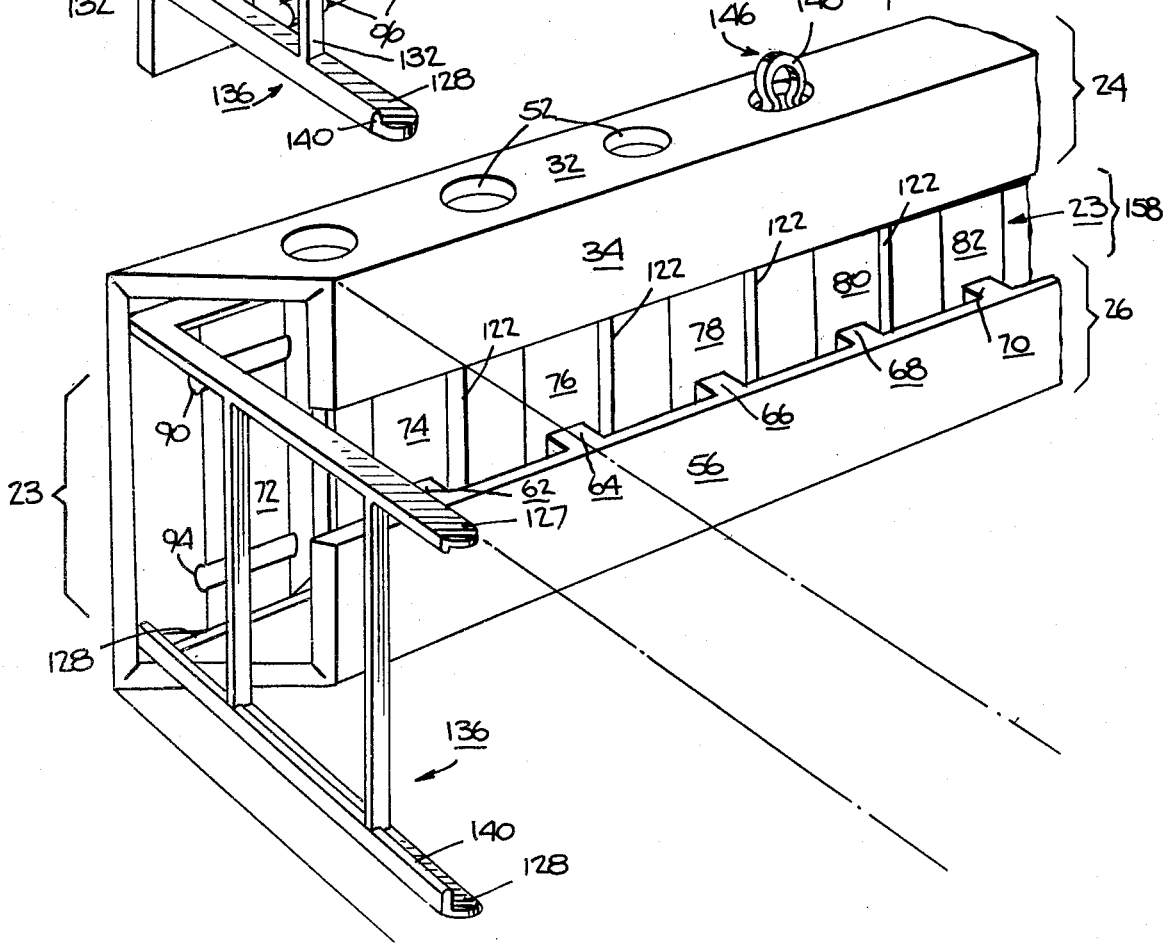
FIG. 7 shows the frame device of FIG. 6 including the angle member and the hanger member in assembled condition.

After the artwork 12 etc. is disposed on the receiving ledge and the hanger members 146 are installed the limb members 24 on each of the frame members 14, 16, 18 and 20 are folded toward and joined with the main body portion 23 to enable the connecting ribs 92 of the bosses 42, 44, 46, 48 and 50 for example to respectively engage the recess slots 90 of the bosses 74, 76, 78, 80 and 82 for example (FIGS. 6, 7 and 12). The hanger members 146, 146 are thus enveloped in a fixed position by the folded limb member 24 and the main body portion 23 of the frame members 14 and 18. A suitable picture frame wire 160 or other similar suspension element can thus be provided in the eyelet portions 148 of the hanger members 146, 146.

Under this arrangement the artwork 12, the protective sheet 13 and the backing material 15 are sandwiched in a channel 158 defined between the folded limb members 24 and 26 of the respective frame members as most clearly shown in FIGS. 2 and 7.

As will be apparent to those skilled in the art, suitable ornamentation decoration or other similar embellishments (not shown) can be formed in or on the exposed surfaces 162, 164 on the assembled frame 10 (FIG. 1). Although not shown, openings similar to the openings 52 can be formed in the limb member 26 for affixing a suitable ornamentation, etc. such as by snapping the ornamentation into the openings. It will also be apparent that no tools are required for assembling the components of the frame 10, or for securing the artwork within the frame.

In another embodiment of my invention shown in FIGS. 14–16 a frame device 170 includes a nonfoldable member 172 formed of wood for example. The nonfoldable member 172 comprises a main body portion 174 and a limb member 176 projecting from the main body portion. An elongated recess 178 is formed in the main body portion 174 and intersecting surfaces are indicated at 177 and 179.

The frame device 170 further includes a foldable member 180 formed of polypropylene for example, comprising a main body portion 182 and a limb member 184 hinged at 186 to the main body portion. An elongated boss 188 on the main body portion 182 is formed with a groove 190 and a fluted projecting extension 192.

The limb member 184 includes foldable sections 194 and 196 having widths respectively defined by elongated folding grooves 198 and 200, and a furrowed free edge 202 and the folding groove 200. A plurality of openings 204, identical to the openings 52, are formed in the foldable section 194. An elongated boss 206 formed on the foldable section 196 includes a terminal surface 208 spaced from the folding groove 200. A connecting rib 210 is formed on the boss 206 and a through-hole 211 is provided in said boss.

As shown in FIGS. 14–16 the frame device 170 is assembled by engaging the fluted extension 192 in the groove 178 to unite the respective main body portions 174 and 182, the extension 192 and the groove 178 being sized to ensure secure detention of said main body portions. The limb member 184 is folded toward and joined with the main body portion 182 to enable the connecting rib 210 to engage the groove 190.

To form a frame for artwork, individual frame members of predetermined size (not shown) are cut from the frame device 170. Preferably the nonfoldable and foldable members 172 and 180 are assembled as shown in FIG. 16 and thereafter cut to size and mitered in any suitable known manner. After the frame members have been mitered the foldable section 196 is unjoined from the main body portion 182 as shown in FIG. 15 by disengaging the rib 210 from the groove 190, as by probing the hole 211 with any suitable object such as a hook (not shown) and pulling away from the main body portion 182.

To assemble a frame for artwork having four sides for example, the mitered end portions of the frame members (not shown) are attached in any suitable known manner such as by nailing the ends together. The limb members 184 on each of the foldable members 180 remain unfolded during the nailing operation to provide a closed peripheral arrangement similar to that shown in FIG. 11. The limb members 176 on the nonfoldable member 172 thus correspond to the limb members 26 of FIG. 11 and form a receiving ledge upon which the artwork and any protective and/or backing materials are disposed.

Although not shown a hanger member 146 is installed in two selected oppositely disposed frame members in corresponding openings 204 as previously described with respect to the assembly of the frame 10. The limb member 184 on each of the peripheral frame members is then folded toward and joined with the main body portion 182 in the manner shown in FIG. 16. The artwork is thus sandwiched in a channel 212 (FIG. 16) between the limb members 176 and 184. The furrowed edge 202 can deflect slightly if the thickness of the artwork slightly exceeds the width of the channel 212.

As will be apparent to those skilled in the art no tools are required for securing the artwork, etc. within the frame or for installing the hanger members 146. The intersecting surfaces 177 and 179 on the nonfoldable member 172 of the frame device 170, which correspond to the surfaces 162 and 164 of the frame 10 (FIG. 1) are exposed to view in a wall-hung assembled frame (not shown) whereas the foldable member 180 cannot ordinarily be seen when the frame is hung. The surfaces 177 and 179 can thus be formed with an attractive decor or finish.

One or more components of the frame device 170 can be formed of material other than plastic or wood if desired. For example, the nonfoldable member 172 can be formed in one piece out of a metal such as aluminum and the foldable member 180 can be formed of rubber.

In another embodiment of my invention shown in FIGS. 17–20 a frame device 220 is connected to a translucent sheet 222 at an edge portion 224 of the sheet. The sheet 222 which can be formed of plastic or other suitable material, includes a groove 226 formed at the edge 224.

The frame device 220 comprises a main body portion 228 having spaced connecting grooves 230 and 232 formed therein similar to the grooves 90 and 94 of the frame device 22. A first limb member 234 hinged at 236 to the main body portion 228 includes connecting ribs 238 and 240 respectively formed on adjoining perpendicular sides. A second limb member 242 hinged at 244 to the main body portion 228 is similar to the foldable limb member 24 of the frame device 22, and includes connecting ribs 246 and openings 248 similar to the ribs 92 and the openings 52.

As shown in FIGS. 17, 18 and 20 the frame device 220 is assembled to the translucent sheet 222 by engaging the rib 238 on the limb member 234 with the groove 226 in the translucent sheet. The limb member 234 is joined to the main body portion 228 in a fixed position thereon by engaging the connecting rib 240 with the grooves 230. If desired the limb member 234 can be formed as an integral projection from the main body portion 228.

A frame device 250 (FIG. 19) identical to the frame device 220 is assembled to an opposite side edge of the translucent sheet 222 (FIG. 19) in the manner already described. The frame devices 220 and 250 each include opposite ends 252 and 254 squared off flush with corresponding edges 256 and 258 of the translucent sheet 222.

To assemble a frame for artwork and any backing material, the artwork etc. (not shown) are disposed against the translucent sheet 222. The limb members 242, 242 on the oppositely disposed frame devices 220, 250 are then folded toward and joined with the respective main body portions 228, 228 in a manner previously described.

Under this arrangement the artwork and the backing material (not shown) are sandwiched in a channel 260 (FIG. 20) defined between the translucent sheet 222 and the folded limb members 242, 242. Either frame device 220 or 250 can correspond to the top edge of the artwork and the assembled frame (not shown) hung at the openings 248 directly onto one or more nails (not shown) or other similar suspension device. If desired, a hanger member 146 can be installed in one of the openings 248 in a manner previously described for engagement with a suitable suspension device such as a hook.

A four sided frame can be provided around the translucent sheet 222 by including two additional frame devices 220, 250 to correspond to the edges 256 and 258 of the translucent sheet 222. Under this arrangement the frame devices 220, 220, 250 and 250 are preferably mitered (not shown) in a manner that will be obvious from the procedure described with respect to mitering of the frame device 170.

An angle member 262 which can be formed for example by cutting the angle member 126, (FIG. 4) at its line of symmetry A—A is used to connect the mitered end portions of the frame devices 220, 250. The lip portion 140 of the angle piece 128 is detented in the recess groove 86 of the main body portion 254 and the webs 130 terminate below the translucent sheet 222. The side 136 of the angle member 262 engages a mitered adjoining frame member (not shown). Additional angle members 262 for adjoining other mitered frame members (not shown) to form a frame of closed periphery are installed in a manner that will be obvious from that previously described for installing the angle members 126 in the frame 10.

In a four sided frame incorporating the frame devices 220, 250 the connecting rib 238 can be omitted from three of the four peripheral frame devices since the angle members 262 will hold the frame devices together to form a closed peripheral arrangement similar to that of FIG. 11. It will be apparent that provision of the connecting rib 238 on only one of the four peripheral frame members is an optional convenience.

Connecting means other than ribs and grooves can be employed to join a frame device such as 220 to the translucent sheet 222. For example, as shown in FIG. 21 a frame device 264 is connected to a translucent sheet 266 by a known connector 268.

In another embodiment of my invention a frame device 270, shown in FIGS. 22–25, is formed of plastic or other suitable material. The frame device 270 comprises a hollow main body portion 272 and a hollow limb member 274 projecting from the main body portion 272. The hollow space defined by the main body portion 272 and the limb member 274 is generally L-shaped and indicated by the reference number 276. A groove 278 is formed in the main body portion 272. A foldable limb member 280 is hinged to the main body portion at 282. The foldable limb member 280 comprises foldable sections 284 and 286 having widths respectively defined by elongated folding grooves 288, 290 and a free edge 292 and the folding groove 290. The folding groove 288 is spaced from a terminal surface 294 of the main body portion 272. A plurality of openings 296, identical to the openings 52, are formed in the foldable section 284 and an elongated rib 298 is formed on the foldable section 286. A through hole 299 is provided in the foldable section 286.

As shown in FIGS. 22–24 the frame device 270 is assembled by folding the limb member 280 toward the main body portion 272 to enable the connecting rib 298 to engage the groove 278.

To form a frame for artwork, a plurality of individual frame members of predetermined size such as the frame member 300 in FIG. 25 are cut from the frame device 270 and mitered in any suitable known manner. Preferably the frame device 270 is assembled as shown in FIG. 24 and thereafter cut to size and mitered to yield the frame member 300. Once the sizing and mitering of frame members such as the member 300 are accomplished the respective limb members 280 are unjoined from the main body portion 272 in the manner shown in FIG. 23. Such disengagement is accomplished by probing the hole 299 with a suitable object such as a hook (not shown) and pulling away from the main body portion 272 to cause the rib 298 to disconnect from the groove 278.

To assemble a four sided frame for example, end portions of the mitered frame members such as 300 are attached with an angle member 302 (FIG. 25). The angle member 302 comprises intersecting side portions 304 and 306 having resilient fluted outer surfaces 308 and 310. The side portions 304 and 306 include inner surfaces 312 and 314 formed with respective intersecting grooves 316 and 318. A fluted flange 320 is formed at an upper end of the intersecting side portions 304 and 306.

As shown in FIG. 25 the side portion 304 of the angle member 302 is insertable in the hollow portion 276 and detented therein by the fluted surface 308 and the fluted flange 320. Although not shown a second mitered frame member incorporating the frame device 270 accommodates the side portion 306 of the angle member 302, and third and fourth frame members similarly incorporating the frame device 270 are mutually connected to themselves and to the first and second frame member to form a closed peripheral arrangement similar to that shown in FIG. 11.

The complete assembly of the frame members such as 300 into a frame is accomplished in a manner that will be obvious from the procedure already described for assembling the frame 10. The limb member 274 thus corresponds to the limb members 26 of FIG. 11 and forms a receiving ledge upon which the artwork and any protective and/or backing materials are disposed. A hanger member 146 is installed in two selected oppositely disposed frame members in corresponding selected openings 296 (FIG. 25).

The limb member 280 on each of the peripheral frame members is then folded toward and joined with the main body portion 272. The artwork is thus sandwiched in a channel 322 (FIG. 24) defined between the limb members 274 and 280 and, the base portion 150 of each hanger member 146 is enveloped in a slot 301.

As will be apparent to those skilled in the art no tools are required to assemble the frame members to form a closed periphery, or to secure the artwork within the frame or to install the hanger members.

Figure 26:
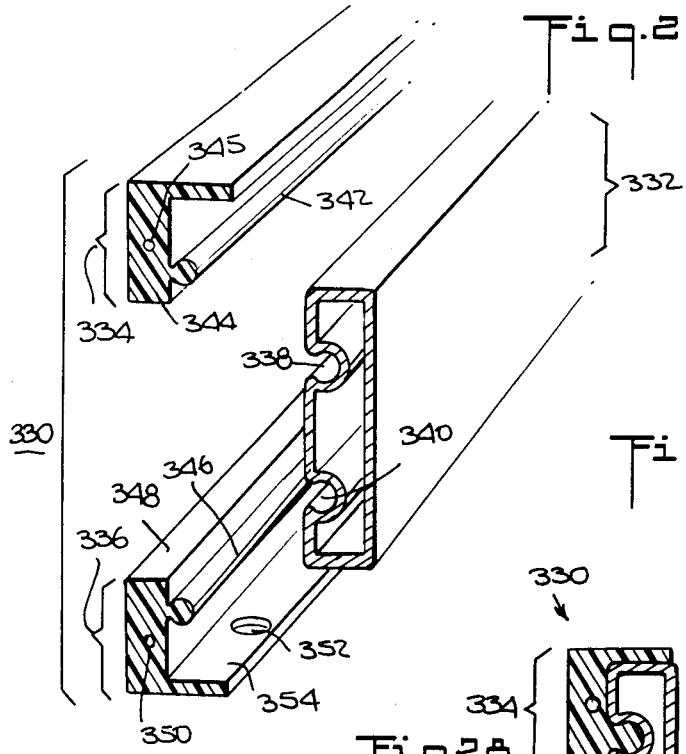
FIGS. 26 and 27 show another embodiment of a frame device incorporating my invention.
Figure 27:
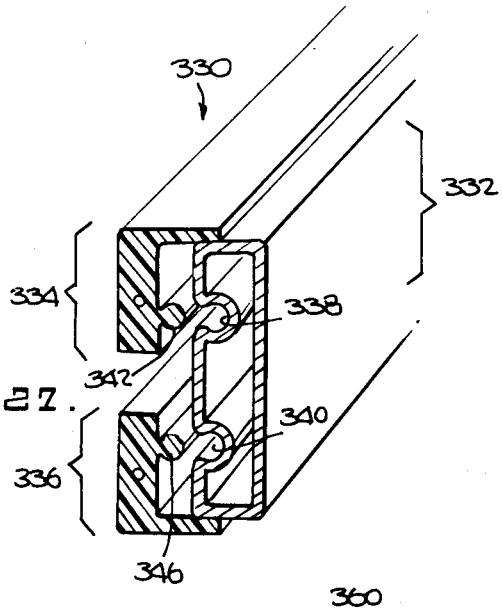
Figure 28:
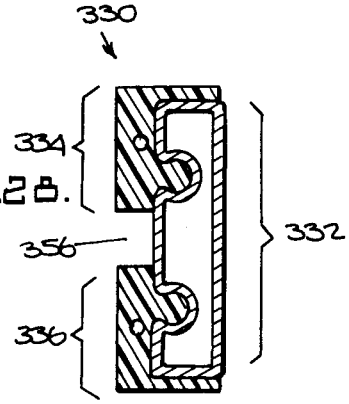
FIG. 28 is an end view showing the frame device of FIGS. 26 and 27 after assembly.

In a further embodiment of my invention a frame device 330 shown in FIGS. 26-28 is formed of any suitable material such as plastic or aluminum. The frame device 330 comprises a main body portion 332 and a pair of limb members 334 and 336.

The main body portion 332 is of hollow construction and includes a pair of oppositely disposed elongated grooves 338 and 340. The limb member 334 is of L-shaped cross section including a rib 342 formed on a leg 344, and a through-opening 345 formed in the leg 344. The limb member 336, also of L-shaped cross section, includes a rib 346 formed on a leg 348 and a through-opening 350 formed in the leg 348. A plurality of openings 352 identical to the openings 52 are formed on a leg 354.

As seen in FIGS. 26–28 the frame device 330 is assembled by joining the limb members 334 and 336 to the main body portion 332 to permit the ribs 342 and 346 to respectively engage the grooves 338 and 340.

To form a frame for artwork a plurality of individual frame members of predetermined size (not shown) are cut from the frame device 330 and mitered in any suitable known manner. Preferably the frame device 350 is assembled as shown in FIG. 28 and thereafter cut to size and mitered.

Once the sizing and mitering of the frame members is accomplished the limb member 336 can be unjoined from the main body portion 332 by disengaging the rib 346 from the groove 340. If desired, the limb member 334 can also be unjoined in a similar manner. Such disengagement of the limb members can be accomplished in any known manner as by providing the holes 345 and 350 with a suitable object such as a hook and pulling away from the main body portion 332.

To assemble a frame for artwork having four sides for example, the limb member 334 of four mitered frame members (not shown) incorporating the frame device 330 is joined to respective main body portions 332. The mitered end portions of the frame members are attached with a suitable angle member (not shown) having legs that are detentable in the hollow opening of the main body portion 332. The structural design of the angle member, although not shown, is a matter of choice and can if desired be of a fluted and grooved format similar to the hanger member 302 of FIG. 25. The structure and operation of such an angle member will be obvious to persons skilled in the art having reference to the angle member 302.

Frame members incorporating the frame device 330 are attached to form a closed peripheral arrangement similar to that shown in FIG. 11, whereby the limb members 334 correspond to the limb members 26 of FIG. 11 and form a receiving ledge upon which the artwork and any protective and/or backing material are disposed.

A hanger member such as 146 is installed in corresponding openings 352 of two selected oppositely disposed limb members 336. Thereafter the limb members 336 of all four frame members are joined to respective main body portions 332 by engaging the respective ribs 346 with the respective grooves 340. The artwork is thus sandwiched in a channel 356 defined between the limb members 334 and 336 (FIG. 28). Although not shown, clearance is provided in any suitable known manner between the limb member 336 and the main body portion 332 for the base portion 150 of each hanger member 146 accommodated in the assembled frame members.

As will be apparent to those skilled in the art no tools are required to assemble the frame members to form a closed periphery, or to secure the artwork within the frame, or to install the hanger members.

Figure 29:
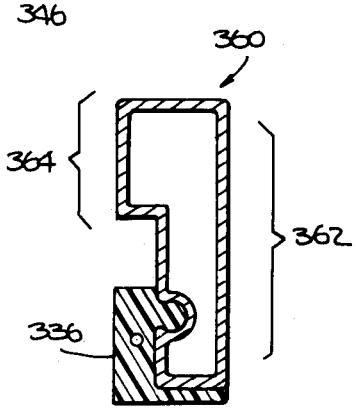
FIGS. 29 and 30 show other embodiments of a frame device incorporating my invention.

If desired the limb member 334 and the main body portion 332 can be integrally formed. For example the embodiment of FIG. 29 shows a frame device 360 comprising a main body portion 362 and a limb portion 364 formed as a unit. The frame device 360 also includes the limb member 336 and is cut into mitered frame members in a manner previously described with respect to the frame device 330. Assembly of frame members incorporating the frame device 360 into a four sided frame for example, is also carried out in a manner similar to that described for a frame comprising the frame device 330.

Figure 30:
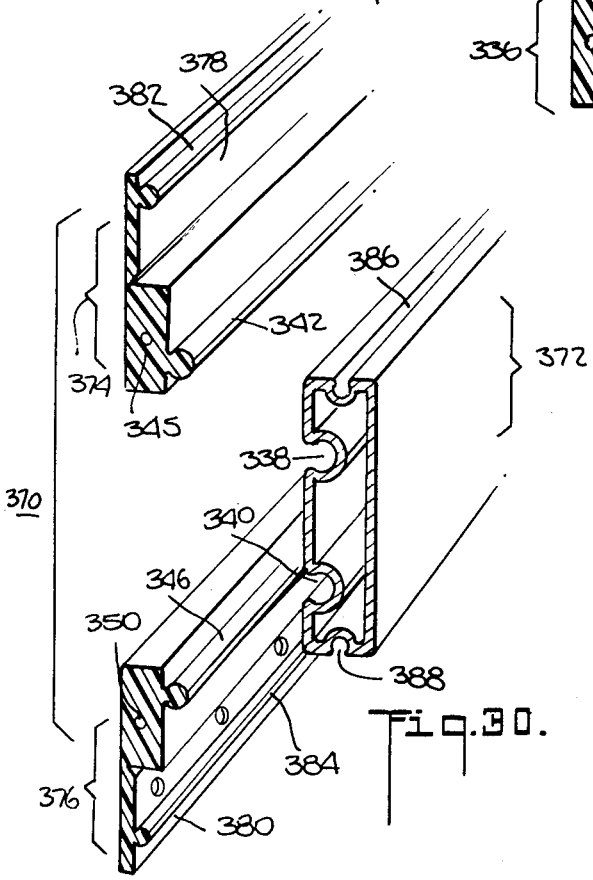
Figure 31:
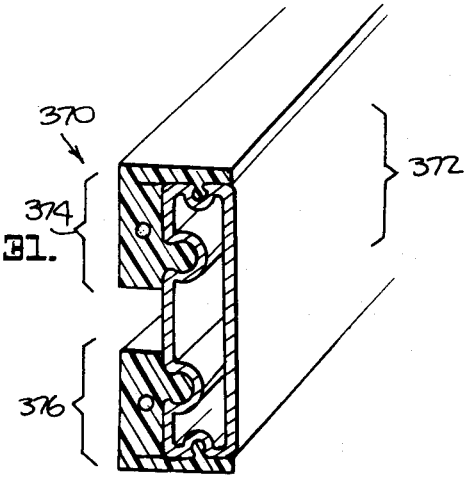
FIG. 31 shows the elements of FIG. 30 folded and assembled.
Figure 32:
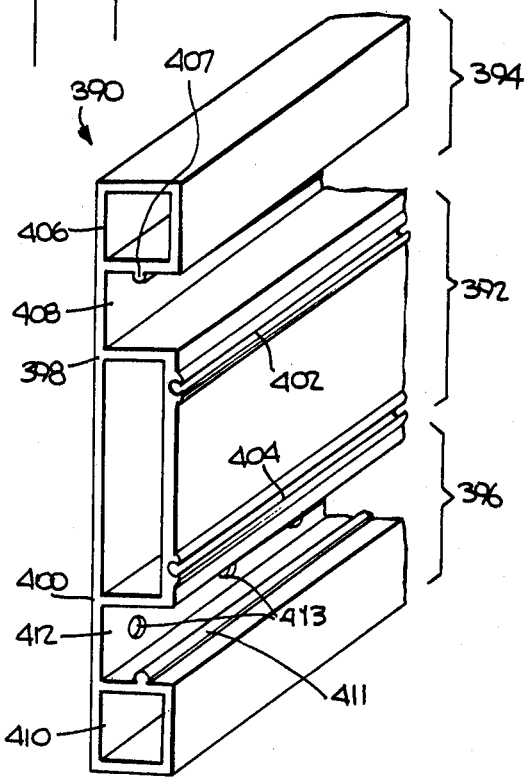
FIG. 32 is another embodiment of a frame device incorporating my invention.
Figure 33:
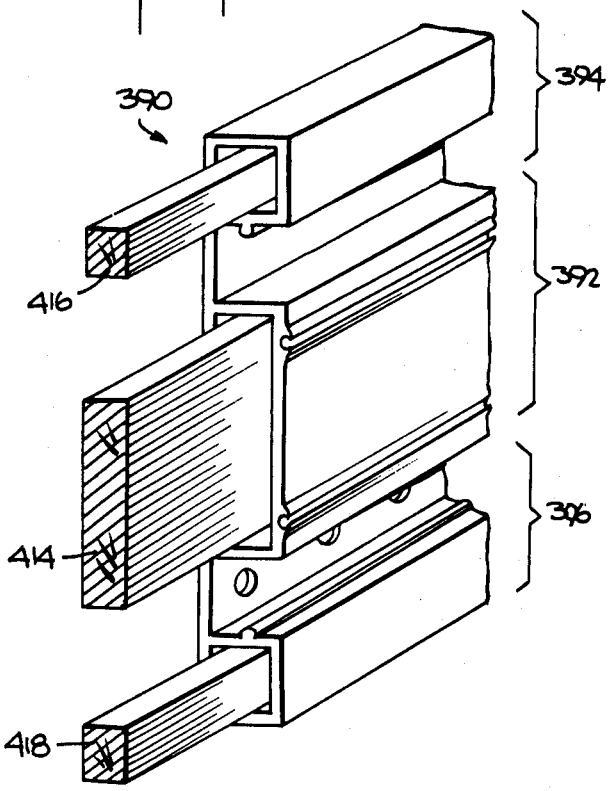
FIG. 33 shows the frame device of FIG. 32 in unfolded condition with inserts partially installed therein.

In another embodiment of my invention a frame device 370, shown in FIGS. 30 and 31, comprises a main body portion 372 and foldable limb members 374 and 376 having respective flaps 378 and 380. Ribs 382 and 384 are respectively formed on the flaps 378 and 380 for engagement in grooves 386 and 388 formed in the main body portion 372. Mitered frame members (not shown) are cut from the frame device 370 in a manner that will be obvious from that previously described with respect to the cutting of mitered frame members from the frame device 330.

A frame for artwork incorporating the frame device 370 is assembled in a manner that will also be obvious from that previously described with respect to the assembly of a frame incorporating the frame device 330.

Although not shown, the limb member 374 and the main body portion can be integrally formed in a similar manner to that described with respect to the frame device 360 of FIG. 29.

In still a further embodiment of my invention a frame device 390 shown in FIGS. 32–35 is formed of any suitable material such as plastic preferably of a heat shrinkable type. The frame device 390 comprises a main body portion 392 and a pair of limb members 394, 396 respectively hinged to the main body portion at 398 and 400. The main body portion 392 is of hollow construction and has a pair of elongated connecting grooves 402 and 404 formed therein.

The limb member 394 comprises a hollow foldable section 406 formed with a connecting rib 407 and a flat foldable section 408. The limb member 396 comprises a hollow foldable section 410 formed with a connecting rib 411 and a flat foldable section 412 provided with openings 413. Folding grooves similar to those shown and described in previous embodiments are formed on the limb members 394 and 396 but are omitted from FIGS. 32–35 for the sake of clarity.

Figure 34:
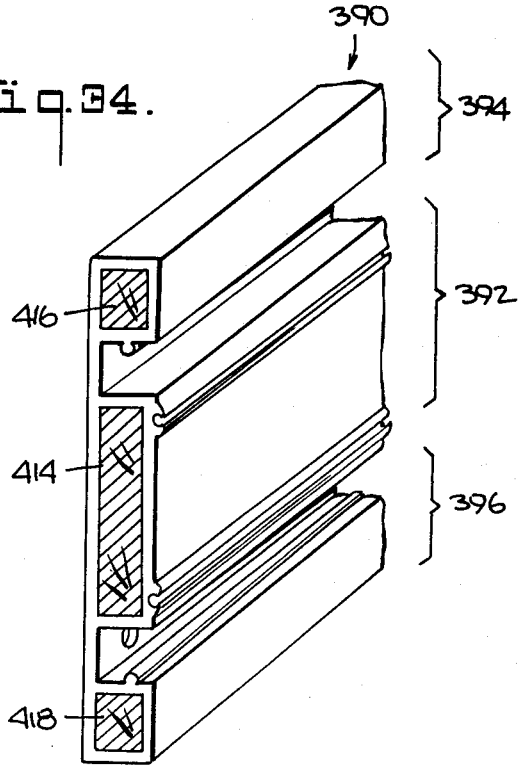
FIG. 34 is a view similar to FIG. 33 with the inserts fully installed.

The main body portion 392, and the hollow foldable sections 406 and 410 respectively accommodate insert members 414, 416 and 418 (FIG. 33) slidably inserted therein. Once the insert members 414 and 416 and 418, which can be formed of wood or other suitable material, have been fully inserted as shown in FIG. 34 the main body portion 392 and the limb members 394, 396 are shrunk in a known manner such as under the influence of heat to form a snug envelope around the inserts.

Figure 35:
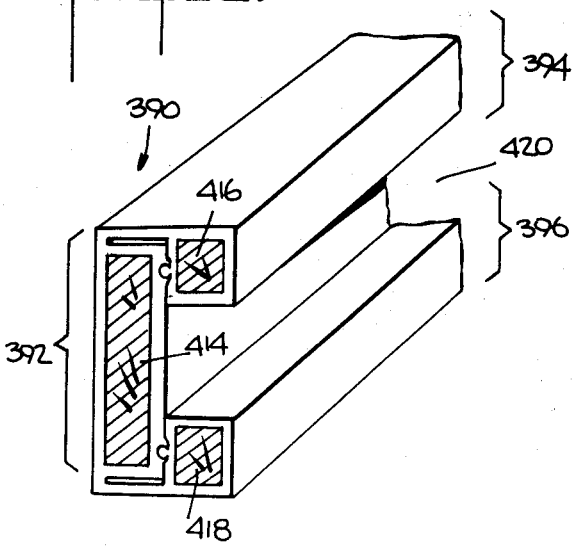
FIG. 35 shows the frame device of FIG. 34 fully folded and assembled.

As shown in FIG. 35 the frame device 390 is assembled with the limb members 394 and 396 folded toward and joined with the main body portion 392 to enable the connecting ribs 407 and 411 to respectively engage the connecting grooves 402 and 404.

To form a frame for artwork a plurality of individual frame members of predetermined size (not shown) are cut from the frame device 390 and mitered in any suitable known manner. Preferably the frame device 390 is assembled as shown in FIG. 35 and thereafter cut to size and mitered. The limb members 394 and 396 can then be unjoined from the body portion 392 by disengaging the ribs 407 and 411 from the grooves 402 and 404. Such disengagement can be accomplished in any suitable manner such as by probing the ends of the inserts 416 and 418 with a suitable object and pulling away from the main body portion 392.

To assemble a frame for artwork having four sides for example, the limb member 394 of each of the frame members (not shown) incorporating the frame device 390 is joined to the respective main body portions 392. The mitered end portions of the frame members are attached in any suitable known manner such as by nailing the ends together. The limb members 396 on each of the frame members can remain unfolded during the nailing operation to provide an arrangement similar to that shown in FIG. 11.

The folded limb members 394 thus correspond to the limb members 26 of FIG. 11 and form a receiving ledge upon which the artwork and any protective and/or backing materials are disposed. A hanger member 146 is installed in corresponding openings 413 of two selected oppositely disposed frame members as previously described with respect to the assembly of the frame 10.

The limb member 396 on each of the peripheral frame members is then folded toward and joined with the main body portion 392. The artwork is thus sandwiched in a channel 420 (FIG. 35) defined between the limb members 394 and 396.

As will be apparent to those skilled in the art no tools are required for securing the artwork within the frame or for installing the hanger members.

Although not shown, hollow metallic inserts can be substituted for the wood inserts 414, 416 and 418. Mitered end portions of frame members with hollow inserts can be attached using insertable angle members of the type described with respect to the embodiments of FIGS. 22–25. The structural design of the angle members is a matter of choice and will be obvious to persons skilled in the art having reference to the angle member 302. Also, if desired, the hollow construction of the frame device 390 can be tubular or elliptical to accommodate rods, tubes or other complementary shaped inserts.

Some advantages of the novel invention disclosed herein include a frame device which yields interchangeable prefabricated frame members that can be assembled into a frame by the ultimate user, a frame device that is easily stored or packaged in an unassembled condition, a frame device that can be formed with any preselected mitering angle to provide a frame comprising more than four frame members or less than four frame members. The angle members would thus be formed to correspond with the mitering angle of the frame member, and generally include side portions defining an angle of approximately twice the mitering angle. Other advantages include a frame device that can be formed of one or more materials to utilize the most desirable aspects of each component material.

As will be apparent to those skilled in the art materials and assembly methods other than those indicated for specific embodiments described herein can be used where suitable. It will also be apparent that the frame devices disclosed herein will accommodate objects other than artwork such as fragile materials, appliances or furnishings requiring peripheral edge protection.

In view of the above it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A frame for artwork having a predetermined thickness and a periphery including a predetermined number of sides defining a plane, said frame comprising a plurality of frame members with opposite mitered end portions, the frame members corresponding in size and number to the predetermined number of sides of said artwork, said frame further including means for joining said opposite mitered end portions together to permit said frame members to surround the periphery of said artwork, at least one of the frame members corresponding to one of the peripheral sides of the artwork being an individual separate member unattached to the other frame members prior to assembly of said frame, said one frame member including a main body portion, first and second spaced and oppositely disposed limb members joined to said main body portion and extending to the opposite mitered end portions of said one frame member, said first and second limb members defining a holding channel for accommodating said artwork such that the plane of said artwork is substantially perpendicular to said main body portion, said one frame member further including engageable latching means provided on said first limb member and said main body portion for latching said first limb member to said main body portion in a first latch engaging position, said first limb member being movable with respect to said main body portion when the latching means on said main body portion and said first limb member is unengaged, said first limb member being immovable with respect to said main body portion when disposed in said first latch engaging position, and wherein engageable latching means are provided on said second limb member and the main body portion of said one frame member for latching said second limb member to said main body portion in a second latch engaging position, said second limb member being movable with respect to said main body portion when the latching means on said main body portion and said second limb member is unengaged, said second limb member being immovable with respect to said main body portion when disposed in said second latch engaging position, said first and second limb members having respective first and second artwork engaging edges defining opposite sidewalls of said holding channel when said first and second limb members are in said first and second latch engaging positions.

2. A frame as claimed in claim 1 wherein the other said frame members respectively accommodate the other peripheral sides of said artwork, the other said frame members each comprising said main body portion and said first and second oppositely disposed limb members joined to said main body portion, said engageable latching means being provided on a first of the limb members of the other said frame members, corresponding to said first limb member on said one frame member, and the main body portion of each of the other said frame members.

3. A frame as claimed in claim 1 wherein the first and second limb members of said one frame member are pivotally joined to said main body portion at respective hinges that form a flexible coupling between the main body portion and said limb members, said first and second limb members being pivotable about said hinges to substantially coplanar disposition with respect to said main body portion when the respective said latching means are unengaged.

4. A frame as claimed in claim 3 wherein said main body portion and said first and second limb members of said one frame member are elongated and formed of flexible material and include a plurality of spaced and parallel indentations formed in said main body portion and said limb members to permit rolling of said main body portion and said first and second limb members into curved configuration when said first and second limb members and said main body portion are in substantially coplanar disposition.

5. A frame as claimed in claim 1 further including indicia means formed on said first and second limb members and said main body portion of said one frame member for defining a miter end portion cutting path.

6. A frame as claimed in claim 5 wherein said indicia means are formed as indentations in said one frame member to facilitate cutting of said mitered end portion.

7. A frame as claimed in claim 1 wherein said latching means comprise respective limb latch members formed on said first and second limb members of said one frame member and corresponding body latch members formed on said main body portion, the corresponding limb and body latching members on said first and second limb members and said main body portion being engageable when said first and second limb members are disposed in said respective immovable positions.

8. A frame as claimed in claim 1 wherein said latching means are releasably engageable.

9. A frame as claimed in claim 1 wherein the mitered end portion joining means include an angle member having a pair of divergent side portions, one of said side portions being disposable against the main body portion of said one frame member at one said mitered end portion when the latching means of said first and second limb members and said main body portion are unengaged, said one of said side portions being held between said main body portion and one of said limb members when the latching means of said one of said limb members and the main body portion of said one frame member are engaged.

10. A frame as claimed in claim 9 wherein the side portions of said angle member include at least one web, and the main body portion of said one frame member is formed with spaced indentations of complementary shape with said web to accommodate said web in a predetermined position on said one frame member when the latching means of said first and second limb members and said main body portion are engaged, said angle member web being unreleasably held between said main body portion and said first and second limb members when the latching means thereon are engaged.

11. A frame as claimed in claim 1 wherein said first limb member is defined by two sections foldable with respect to each other.

12. A frame as claimed in claim 11 wherein said main body portion and one of said foldable sections have discontinuous discrete opposite end portions, the discrete opposite end portions of said main body portion extending beyond the discontinuous discrete opposite end portions of said one of said foldable sections.

13. A frame as claimed in claim 12 wherein the other said foldable section has discrete opposite end portions, that extend from the discrete end portions of the main body portion to the discontinuous discrete end portions of said one of said foldable sections.

14. A frame as claimed in claim 13 further including indicia means formed on said first and second limb members and said main body portion of said one frame member to define cutting guidelines for cutting miter end portions on said frame member.

15. A frame as claimed in claim 1 further including means for for suspending said frame and wherein at least one through opening is formed in said first limb member for accommodating said means for suspending said frame.

16. A frame for artwork having a predetermined thickness and a periphery including a predetermined number of sides defining a plane, said frame comprising a plurality of frame members with opposite mitered end portions, the frame members corresponding in size and number to the predetermined number of sides of said artwork, said frame further including means for joining said opposite mitered end portions together to permit said frame members to surround the periphery of said artwork, at least one of the frame members corresponding to one of the peripheral sides of the artwork being an individual separate member unattached to the other frame members prior to assembly of said frame, said one frame member including a main body portion, first and second spaced and oppositely disposed limb members joined to said main body portion and extending to the opposite mitered end portions of said one frame member, said first and second limb members defining a holding channel for accommodating said artwork such that the plane of said artwork is substantially perpendicular to said main body portion, said one frame member further including engageable latching means provided on said first limb member and said main body portion for latching said first limb member to said main body portion in a first latch engaging position, said first limb member being movable with respect to said main body portion when the latching means on said main body portion and said first limb member is unengaged, said first limb member being immovable with respect to said main body portion when disposed in said first latch engaging position and wherein said means for suspending said frame include a hanger member comprising an eyelet portion of smaller dimension than said opening, said eyelet portion being insertable in said opening when the latching means of said first limb member and said main body portion is unengaged, said hanger member having a base portion of larger dimension than said opening, said base portion being held in said frame member when said eyelet portion is inserted in said opening and the latching means of said first limb member and said main body portion is engaged.

17. A frame for artwork having a predetermined thickness and a periphery including a predetermined number of sides defining a plane, said frame comprising a plurality of frame members with opposite mitered end portions, the frame members corresponding in size and number to the predetermined number of sides of said artwork, said frame further including means for joining said opposite mitered end portions together to permit said frame members to surround the periphery of said artwork, at least one of the frame members corresponding to one of the peripheral sides of the artwork being an individual separate member unattached to the other frame members prior to assembly of said frame, said one frame member including a main body portion, first and second spaced and oppositely disposed limb members joined to said main body portion and extending to the opposite mitered end portions of said one frame member, said first and second limb members defining a holding channel for accommodating said artwork such that the plane of said artwork is substantially perpendicular to said main body portion, said one frame member further including engageable latching means provided on said first limb member and said main body portion for latching said first limb member to said main body portion in a first latch engaging position, said first limb member being movable with respect to said main body portion when the latching means on said main body portion and said first limb member is unengaged, said first limb member being immovable with respect to said main body portion when disposed in said first latch engaging position, and wherein the mitered end portion joining means include an angle member having a pair of divergent side portions, one of said side portions being disposable against the main body portion of said one frame member at one said mitered end portion when the latching means of said first limb member and said main body portion of said one frame member are unengaged, said one of said side portions being held between said main body portion and said first limb member when the latching means of said first limb member and said main body portion are engaged.

18. A frame as claimed in claim 17 wherein the side portions of said angle member include at least one web, and the main body portion of said one frame member is formed with spaced indentations of complementary shape with said web to accommodate said web in a predetermined position on said one frame member when the latching means of said first limb member and said main body portion are unengaged, said angle member web being unreleasably held between said main body portion and said first limb member when the latching means thereon are engaged.

* * * * *